United States Patent [19]

Steinbrecher

[11] 3,984,144

[45] Oct. 5, 1976

[54] STEP A DESK CHILDREN'S CABINET

[75] Inventor: Duane C. Steinbrecher, Williston, N. Dak.

[73] Assignee: The Raymond Lee Organization, Inc., New York, N.Y. ; a part interest

[22] Filed: Mar. 26, 1975

[21] Appl. No.: 562,342

[52] U.S. Cl. ..... 297/174; 182/33

[51] Int. Cl.[2] ..... A47B 39/00

[58] Field of Search ..... 297/174, 148, 149, 153, 297/135, 124, 156, 119, 120, 172; 312/194, 195, 235; 108/63; 182/33.3, 33.6, 33

[56] References Cited

UNITED STATES PATENTS

| | | | |
|---|---|---|---|
| 1,557,342 | 10/1925 | Schlamp | 182/33.3 |
| 1,635,183 | 7/1927 | Jeannotte | 182/33 |
| 1,820,904 | 9/1931 | Beck | 108/63 |
| 3,367,712 | 2/1968 | Greene | 297/124 |
| 3,811,533 | 5/1974 | Cocker | 182/33 |

FOREIGN PATENTS OR APPLICATIONS

| | | | |
|---|---|---|---|
| 929,272 | 5/1955 | Germany | 297/124 |
| 138,820 | 6/1930 | Switzerland | 182/33 |

*Primary Examiner*—Roy D. Frazier
*Assistant Examiner*—Darrell Marquette
*Attorney, Agent, or Firm*—Howard I. Podell

[57] ABSTRACT

A stepped desk cabinet for use by women and children. The cabinet is formed of two stepped sides which support a horizontal flat desk top and a horizontal seat located below and to the side of the desk top. The desk top comprises a double panel, with the top leaf hinged to the bottom leaf which is fixed in place so that the top leaf may be folded about to a horizontal position, flush with the bottom leaf and extending over the seat. A removable panel is mounted inside the unit as a continuation of the seat, to serve as the top of a storage cabinet bounded by the removable panel and seat, the two sides, and a back panel covering the lower half of the back of the cabinet.

2 Claims, 3 Drawing Figures

STEP A DESK CHILDREN'S CABINET

SUMMARY OF THE INVENTION

My invention is a stepped desk cabinet for use by women and children. The cabinet is formed of two stepped sides which support a horizontal flat desk top and a horizontal seat located below and to the side of the desk top. The desk top comprises a double panel, with the top leaf hinged to the bottom leaf which is fixed in place so that the top leaf may be folded about to a horizontal position, flush with the bottom leaf and extending over the seat. A removable panel is mounted inside the unit as a continuation of the seat, to serve as the top of a storage cabinet bounded by the removable panel and seat, the two sides, and a back panel covering the lower half of the back of the cabinet.

The removable panel is lifted out of the cabinet when the apparatus is employed as a combination desk and seat. The underside of the foldable back panel may be marked as a game board, with the sides and back panel marked in the outline of windows and doors of a house, barn and other designs.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
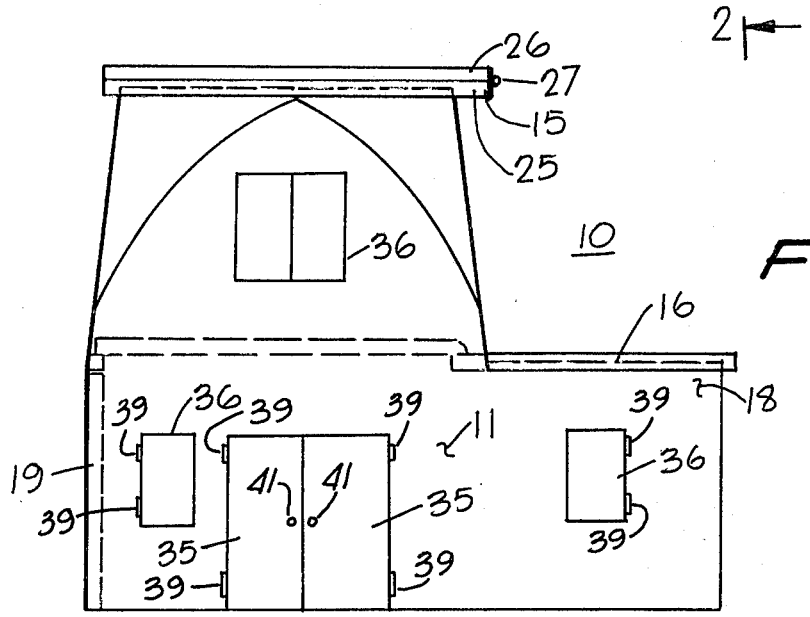
FIG. 1 is a side elevation view of the cabinet.
Figure 2:
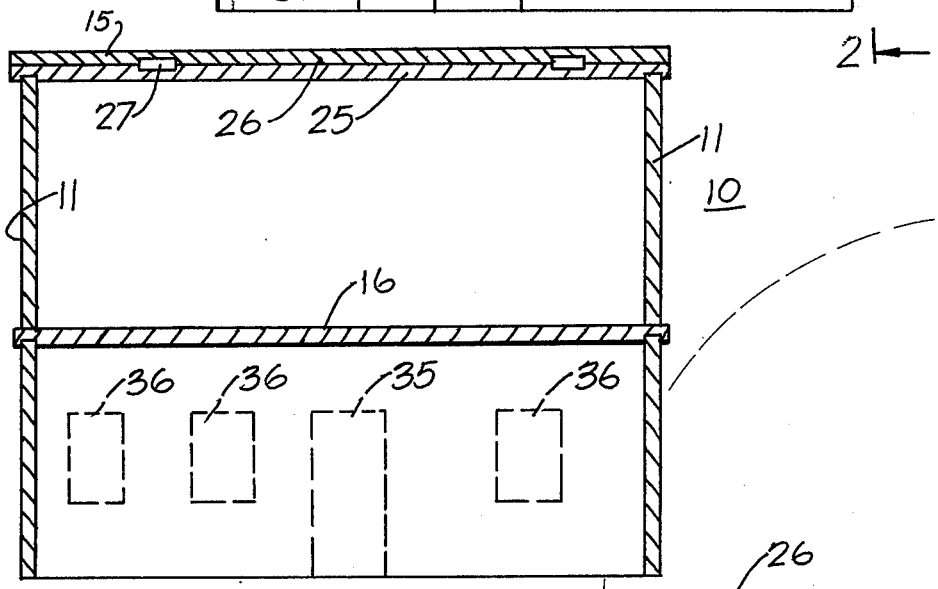
FIG. 2 is a front elevation view of the cabinet taken along line 2—2 of FIG. 1.
Figure 3:
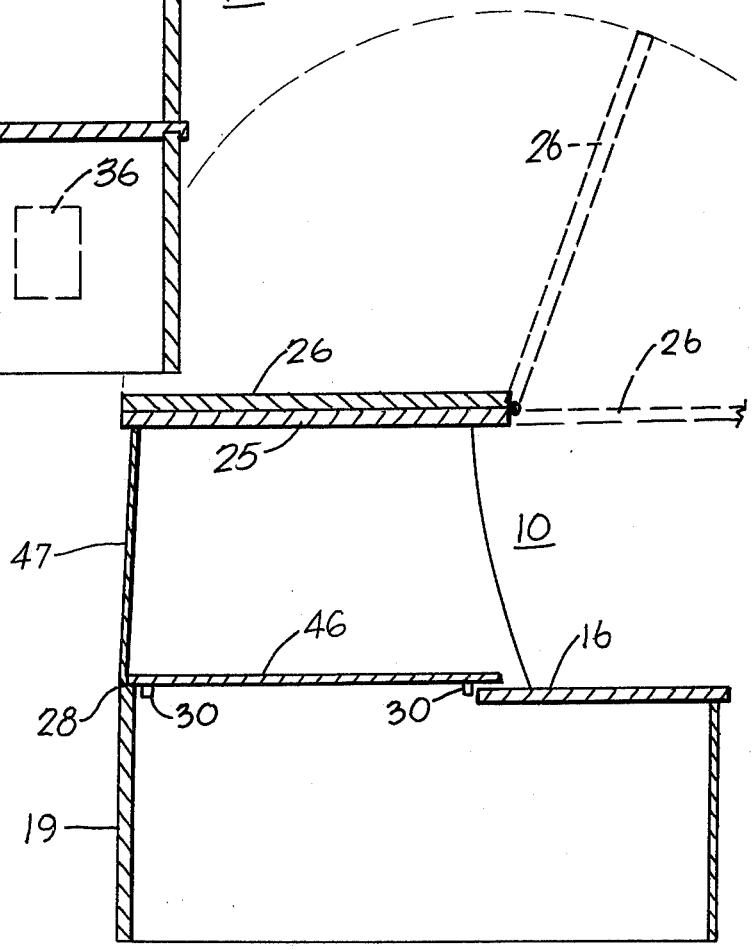
FIG. 3 is a side sectional view of the cabinet.

Turning now descriptively to the drawings, in which similar reference characters denote similar elements throughout the several views, FIGS. 1–3 illustrate the combination Desk and Cabinet 10 which is formed of two stepped side panels 11, a horizontal top double panel 15, a horizontal seat panel 16 mounted on the lower stepped portion 18 of the side panels 11 so as to extend beyond the front of the top panel 15 when the top panel is in the folded condition shown in FIG. 1, and a back panel 19 that joins the lower sections of the side panels 11. A decorative panel 47 extends above panel 19 to the top panel 15.

Desk top panel 15 is formed of two leafs 25 and 26 joined together by hinges 27 so that upper leaf 26 may be folded 180° about hinges 27 to form a continuation of the horizontal surface of fixed lower panel 25, extending over horizontal seat 16.

Inner panel 46 rests on the upper end 28 of back panel 19 and is held in place by stops 30 projecting from the underside of panel 46. Inner panel 46 forms a removable top for a toy storage cabinet, when the cabinet is not employed as a combination chair and desk.

The side panels 11 and back panel 19 are marked with the outlines of doors 35 and windows 36 and with other such markings so that the sides and back of the cabinet may resemble a house or barn, with doors 35 and windows 36 actually cut-out about their outline markings and fitted with hinges 39 so that they may be opened. Knobs 41 may be fitted to the doors 35.

In use, desk top and panel 15 may serve as a step landing on which a woman may reach into wall cabinets or to ceiling or wall lighting fixtures. A child may stand on desk top panel 15 when washing at a sink.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A combination children's desk, which alternately serves as a table or a portable step for adults or as a storage cabinet or as a child's toy, comprising a pair of stepped sides that support a top horizontal desk panel and a parallel lower horizontal seat panel, with the said seat panel supported on the stepped portions of said side panels so as to extend away from said top panel, with a back panel joining the lower portion of the side panels, along the edge of the side panels opposed to the stepped section of the side panels, together with a removable cove panel engageable with the upper edges of the back panel and one end of the seat panel, such that the said lower portion of the side panels, and the back panel enclose a storage area covered by the said seat panel and the said removable cover panel, when the said cover panel is in place, with removal of the said cover panel forming an open enclosure under the said desk panel to permit a user seated on the said seat panel and facing the desk panel to extend the legs of the user under the desk panel into said enclosure, in which the said top desk panel is formed of two leaves joined together along one of their common edges by hinges so that the upper leaf may be folded 180° to lie along and form a continuation of the plane of the surface of the fixed lower leaf, such that the said upper leaf extends above and projects beyond the other end of said seat panel to form a table top.

2. The combination as recited in claim 1 in which the upper surfaces of the leaves of the top panel, in the extended position, are marked in the form of a game board.

* * * * *